US007708623B2

(12) United States Patent
Junker

(10) Patent No.: US 7,708,623 B2
(45) **Date of Patent: *May 4, 2010**

(54) CYLINDRICAL GRINDING METHOD FOR PRODUCING HARD METAL TOOLS AND CYLINDRICAL GRINDING MACHINE FOR GRINDING CYLINDRICAL STARTING BODIES DURING THE PRODUCTION OF HARD METAL TOOLS

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/069,856

(22) Filed: Feb. 13, 2008

(65) Prior Publication Data

US 2008/0139091 A1 Jun. 12, 2008

Related U.S. Application Data

(63) Continuation of application No. 10/547,104, filed as application No. PCT/EP2004/001760 on Feb. 23, 2004, now Pat. No. 7,393,261.

(51) Int. Cl.
*B24B 41/06* (2006.01)

(52) U.S. Cl. ..... 451/402; 451/5; 451/6; 451/8

(58) Field of Classification Search ..... 451/5, 451/8, 194, 57, 177, 49, 182, 58, 56, 402
See application file for complete search history.

(56) References Cited

U.S. PATENT DOCUMENTS

| | | | | |
|---|---|---|---|---|
| 1,904,568 | A * | 4/1933 | Taylor | 51/297 |
| 3,610,075 | A * | 10/1971 | Fabish | 76/108.6 |
| 4,802,311 | A * | 2/1989 | Scheder et al. | 451/17 |
| 4,831,907 | A * | 5/1989 | Gnann | 82/47 |
| 5,527,210 | A * | 6/1996 | Sharer | 451/408 |
| 5,857,896 | A * | 1/1999 | Stollberg | 451/47 |
| 5,885,199 | A * | 3/1999 | Shao | 483/19 |
| 6,190,242 | B1 * | 2/2001 | Herrscher et al. | 451/177 |
| 6,431,954 | B1 * | 8/2002 | Junker | 451/11 |
| 6,669,532 | B1 * | 12/2003 | Mukai et al. | 451/7 |
| 2002/0066197 | A1 * | 6/2002 | Sano et al. | 33/549 |
| 2004/0106356 | A1 * | 6/2004 | Varney et al. | 451/5 |
| 2004/0248502 | A1 * | 12/2004 | Junker | 451/11 |

FOREIGN PATENT DOCUMENTS

JP 411277426 * 10/1999

* cited by examiner

*Primary Examiner*—Joseph J Hail, III
*Assistant Examiner*—Robert Scruggs
(74) *Attorney, Agent, or Firm*—Jordan and Hamburg LLP

(57) ABSTRACT

A grinding method and to a cylindrical grinding machine grinds metal rod that is pushed through a chuck of a workpiece spindle head. Two backrest seats are ground on and two backrests are then seated. The support of an end area enables a front cone to be ground. A grinding wheel comprised of two different individual wheels serves to grind the front cone and is advanced toward the round rod in the X-direction. The front cone is lodged in a hollow punch at a front end of a quill by displacement of the quill. The desired cylindrical grinding a final contour of the end area is done. Working the rod is done with a single chucking and the end area is cut off from the round rod by one of the individual wheels.

21 Claims, 5 Drawing Sheets

CYLINDRICAL GRINDING METHOD FOR PRODUCING HARD METAL TOOLS AND CYLINDRICAL GRINDING MACHINE FOR GRINDING CYLINDRICAL STARTING BODIES DURING THE PRODUCTION OF HARD METAL TOOLS

BACKGROUND OF THE INVENTION

The invention relates to a method for circular grinding during the production of tools made of hard metal on a circular grinding machine that has a workpiece spindle head and a tailstock, whereby work commences using a round rod comprising a starting material.

According to the prior art known from commercial practice, as a rule work commences starting with round rods made of sintered hard metal. These rods then have a grinding overmeasure for the shaft region and are cut to the necessary tool length, or the starting bodies are brought to the required shaft dimension for their entire length using so-called centerless grinding and are then cut into lengths. From the bar pieces that were cut into lengths individually, the tool is then produced from the whole by grinding. For this, the hard metal tools are received during grinding between hollow center punches, tips, or in a chuck.

Grinding occurs either using the conventional grinding method or using the rough grinding method by means of diamond grinding wheels. In any case, multiple instances of re-chucking are required because first the individual bar pieces are produced by grinding and cutting into lengths, where necessary in the reverse sequence as well, and then in subsequent grinding processes that take place on other machines the tool contours are ground and cutting, gradation, spiral cutting, and the like occur.

The known methods in accordance with the prior art work satisfactorily, however they entail the risk of errors in the trueness of the run. These errors are related primarily to multiple instances of re-chucking. Even if work is performed with great attention to precision, such errors in the trueness of the run cannot always be avoided. They are entirely and unpleasantly noticeable on the finished tool. This is particularly true of high-speed processing, for instance in aircraft construction. In this case, cutting tools are used that work at speeds of 30,000 to 60,000 rpms. When processing the light metal parts that are widely used in aircraft construction, even the smallest error in the trueness of the run on the tool is disturbingly noticeable.

BRIEF SUMMARY OF THE INVENTION

The object of the invention is therefore to improve the method known from the prior art such that errors in the trueness of the run are avoided with certainty and at comparable production costs.

This object is achieved using the following method steps:

a) Gripping the round rod, whose length is a multiple of the length of a single tool, in a chuck of the workpiece spindle head that when the chuck is released enables axial displacement of the round rod, whereby an end region of the round rod that projects out of the workpiece spindle head faces the tailstock;

b) Grinding at least one steady rest on the end region of the round rod that projects from the workpiece spindle head and placing the steady on the steady rest;

c) Grinding a first end-face taper on the end face of the round rod that faces the tailstock;

d) Secure-clamping fitting of the first end-face taper with a hollow center punch that is located on a sleeve of the tailstock;

e) Circular grinding of the end region of the round rod that projects from the workpiece spindle head over approximately the entire length that corresponds to the individual tool up to its circular-ground final contour;

f) Cutting off the thus finish-ground individual tool from the round rod;

g) Releasing the chuck of the workpiece spindle head, which to this point has remained clamped, moving the round rod in the workpiece spindle head in the direction of the tailstock, and then loading the chuck, whereby an additional end region of the round rod, which end region is to be processed, projects from the workpiece spindle head.

According to the inventive method, thus "work is performed on the running rod". For this, the round rod that comprises sintered hard metal and that can for instance have a length of 300 to 400 mm, is gradually moved through the chuck of the workpiece spindle head and securely clamped each time a specific end region of the round rod that approximately corresponds in length to the tool to be produced projects from the workpiece spindle head and faces the tailstock. The special feature of the inventive method is that the projecting end region, even while it is joined to the rest of the round rod, is ground down to its circular-ground final contour. The circular-ground final contour of the hard metal tool to be produced is that contour of the finished tool that is to be produced by circular grinding. Then cutting, spiral cutting, and the like are performed on the tool in subsequent methods.

Since the end region projecting from the workpiece spindle head can have a considerable length depending on the tool, it is necessary to grip it at its free end, which is another reason a very precise contour is required. Therefore in the inventive method initially at least one steady rest is ground onto the free projecting end region. Then, if the end region is supported by means of the at least one steady rest on one or a plurality of steadies, a first end-face taper can be ground with the required precision onto the end face of the round rod, that is, of its end region, that faces the tailstock. The end-face taper is then fitted in a securely clamped manner with a hollow center punch on a sleeve of the tailstock. The end region is now again gripped at its two ends without it having been necessary to release the first clamping in the workpiece spindle head. Circular grinding can again be performed with the required precision on the already described circular-ground final contour.

Then the thus finish-ground individual tool is cut off from the round rod; the chuck of the workpiece spindle head, which to this point has remained clamped, is released, and the round rod is moved forward a bit in the released chuck in the direction of the tailstock, whereby another end region of the round rod that is to be processed projects from the workpiece spindle head.

In the present context, the description of a "thus finish-ground individual tool" is somewhat different from finish-grinding in the sense of finish-cut as opposed to rough-turned. Nor does it mean that the hard metal tool to be produced must now be ready for use. On the contrary, here the term finish-ground merely means that the resulting hard metal tool is as finish-ground in its first clamping as is the object of the circular grinding, that is, just to its desired circular-ground final contour.

The advantages of the inventive method are comprised above all in that multiple clamping is avoided. Thus re-chucking errors are avoided, and the result is the best circular trueness of the run results and shape and position tolerances relative to the shaft and cut part. Despite higher acquisition costs for the circular grinding machine, the costs for the individual workpiece are reduced because the resulting tool is processed in a single machine from unmachined part to rough-finished part or even finished part. Furthermore, through-times are reduced, and it is possible to react very rapidly to an order for a specific hard metal tool because the desired end regions can be cut off of the round rod in different lengths. Thus, finally, the stored inventory of semi-finished products can be reduced because production is flexible and rapid.

One advantageous further development of the inventive method is comprised in that during circular grinding of the end region of the round rod that projects from the workpiece spindle head, the steady is retracted from the steady rest. The steady acts primarily to grind with the greatest possible precision the clamped end of the end region of the round rod that projects from the workpiece spindle head and that faces the tailstock. On the other hand, the grinding of the workpiece contour can occur without additional support from steadies. This simplifies processing, and it is possible to attain with nothing further a perfect surface of the circular-ground final contour.

In the case of high demands in terms of precision, even for thin round rods, two steady rests can be ground axially spaced from one another on the end region of the round rod. In many cases, that is, with shorter hard metal tools, only one steady rest will be adequate, however.

Another advantageous embodiment of the inventive method is comprised in that the end region of the round rod that projects from the workpiece spindle head is separated from the remaining round rod after circular grinding in that with a single grinding wheel first with the round rod rotating a second end-face taper is ground on the end face of the thus finished tool that faces the workpiece spindle head and then after the grinding wheel has been retracted and axially displaced relative to the round rod a separating cut leaving only a central connecting band is applied and finally after the rotational movement of the round rod has ceased the separation process is concluded by grinding off the connecting band.

Using this approach, the projecting end region of the round rod remains joined to the rest of the round rod until the last possible moment, namely, via the central connecting band. Thus two-sided clamping of the end region without repeated re-chucking is possible until the very end, and processing accuracy is further enhanced without additional complexity. Furthermore, grinding can proceed on the rotating round rod for as long as possible, which is advantageous for the thermal stress on the resulting tool.

When the finish-ground individual tool has been finally cut off, the tailstock and/or the sleeve are then retracted from the resulting finished tool, and the tool is held by a clamping unit. Once the separating process has concluded, the clamping unit can remove the thus finished tool from the machine and deposit it, further enhancing the efficiency of the method.

The known circular grinding techniques can be used for the most important process of circular grinding in accordance with method step e) above. Thus the circular grinding can occur for producing the tool contour with a narrow grinding wheel in the rough grinding method and/or with a wide grinding wheel in a pendulum grinding method.

The inventive method can be performed both in a nearly manual procedure and in a highly automated design. In the latter case, care must be taken above all that the last rod piece to be processed is not gripped in the chuck of the workpiece spindle head with an axial extension that is not long enough. If this happens errors occur that are due to poor trueness of the run as a result of the gripping length being too short. Incomplete chucking can lead to damage of the machine or even accidents if the proper care is not exercised. In order to prevent this, in accordance with another embodiment of the inventive method it is provided that the rest of the length of the round rod that remains available for moving the round rod through the chuck of the workpiece spindle head is checked at least during every chucking process and when it does not meet a certain minimum remaining length a signal is given and/or the circular grinding machine is stopped.

In this manner the greatest possible safety is provided for the method.

The invention also relates to a circular grinding machine for grinding cylindrical starting bodies during the production of tools made of hard metal.

Such an inventive machine is provided with a machine bed, with a grinding table that can travel on the machine bed and on which are arranged a workpiece spindle head and a tailstock, with a chuck on the workpiece spindle head that enables a round rod acting as a starting material to be moved through and chucked in different axial positions, with at least one steady arranged in the region between the workpiece spindle head and the tailstock and with a gripping unit arranged in the same region, whereby an end region of the round rod that has been moved through the chuck of the workpiece spindle head and securely clamped can additionally be held selectively by the tailstock and/or the steady and/or the gripping unit, and with at least one grinding spindle head with one or a plurality of grinding spindles and that can be used to position one or a plurality of different grinding wheels at the round rod.

Thus, in the inventive machine a number of features cooperate such that the described advantages of the method can be attained. In addition to the chuck of the workpiece spindle head, which permits the round rod comprising hard metal to be moved through and gradually clamped, the numerous devices for supporting the projecting end region of the round rod are also necessary, that is, the tailstock, the one or a plurality of steadies, and selectively also the gripping unit. The cooperation of all of these individual parts is necessary in the prescribed sense so that the hard metal tools can be produced economically and yet with great precision.

Fundamentally it is possible with the inventive circular grinding machine to make due with a single grinding wheel if it is caused to engage the round rod in an inclined position.

In this manner the end-face taper can be applied to the two ends of the resulting tool, while when the grinding wheel and round rod are set parallel, circular grinding can be performed to the desired final contour. However, it is preferred when in accordance with one embodiment of the inventive circular grinding machine a grinding spindle head is provided that carries two grinding spindles and that can be pivoted about a pivot axis that is oriented perpendicular to a plane in which lies the common axis for workpiece spindle head, round rod, and tailstock.

In this manner two different grinding spindles can be brought into the working position rapidly, each of these grinding spindles being able to carry a plurality of grinding wheels.

Particularly preferred is the arrangement of a multiple grinding wheel in which two or more grinding wheels of differing diameter, differing width, and/or differing exterior contour are located immediately adjacent to one another on a common driven axis.

In this manner a very specific grinding wheel that is specially embodied for a specific procedure is employed without interference from the grinding wheel located immediately adjacent thereto. For instance, of two adjacent individual wheels, the one can be embodied for circular grinding in the rough grinding method while the other, with a spherical grinding contour, grinds an end-face taper in the optimum manner.

When there is a demand for greater numbers of these multiple grinding wheels, it can also be advantageous that the different grinding wheels are combined into a common grinding body. There is then an adapted shaped grinding body for which only a single carrier body is required.

The inventive circular grinding machine can be advantageously provided with CNC control, which then largely automates the entire grinding procedure.

Given the problems described in the foregoing because of which it is necessary especially in a highly automated procedure to automatically monitor the grinding procedure, in accordance with another advantageous embodiment, allocated to the chuck of the workpiece spindle head is a sensor that checks the remaining length of the round rod that is available for moving the round rod through the chuck, at least during every chucking procedure, and when a minimum remaining length is not met provides a signal and/or stops the circular grinding machine.

In such an embodiment a situation is avoided with certainty in which the last remaining piece of a round rod that does not have a clamping length that is long enough is ground, which can easily result in errors or even accidents.

In addition, in the inventive circular grinding machine, a tailstock with a sleeve carrying a hollow center punch is used in an advantageous manner. A hollow center punch is particularly well suited for centering the end-face taper of a cylindrical part and securely receiving it.

The inventive method and the inventive circular grinding machine are not only particularly well suited for grinding hard metal tools, but also for all workpieces with similarly borne contours and problems.

BRIEF DESCRIPTION OF THE DRAWINGS

The invention is explained in greater detail using the exemplary embodiments depicted in the following figures in which.

DETAILED DESCRIPTION OF THE INVENTION

Figure 1:
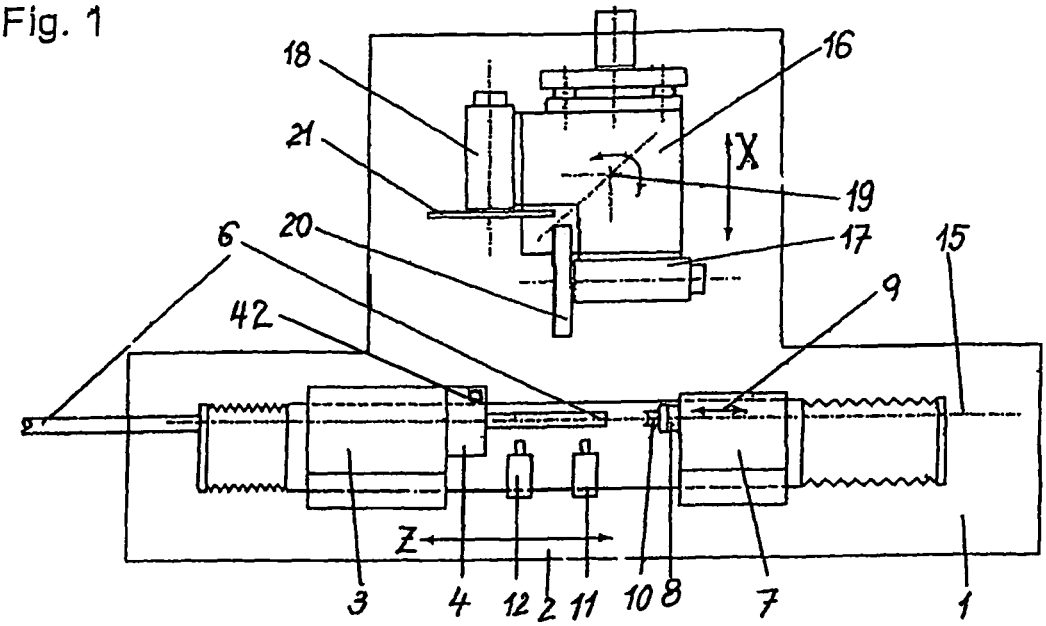
FIG. 1 is a view from above of a grinding machine for performing the inventive method.
Figure 2:
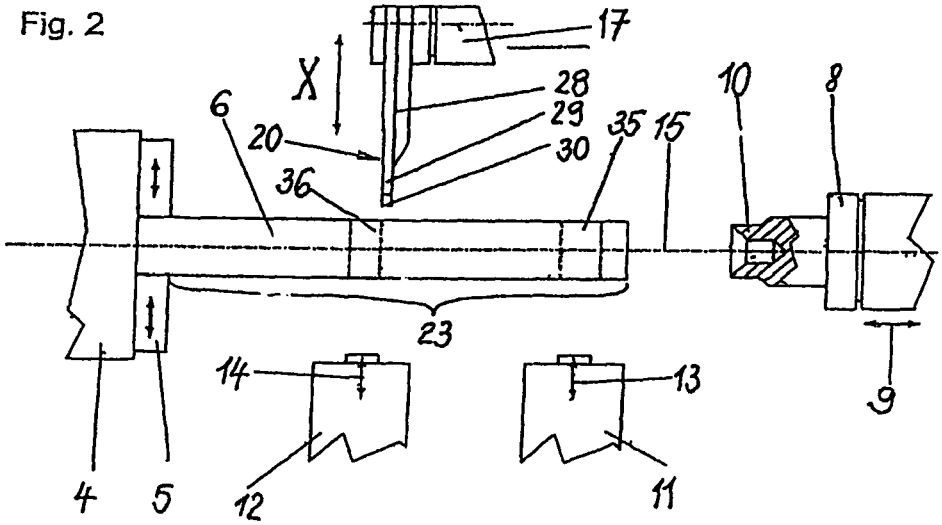
FIG. 2 depicts the details of the grinding machine in accordance with FIG. 1 during grinding of steady rests.

FIG. 1 is the simplified view from above of a grinding machine for performing the inventive method. The machine bed is labeled with the number 1, and in the front region a grinding table 2 is placed on it. The grinding table 2 can travel in the direction of the axis Z by means of a CNC control. Placed on the grinding table 2 on the left-hand side is a workpiece spindle head 3 that receives a chuck 4 that is driven rotationally by means of an electromotor (not shown). The chuck 4 can be seen at the front of the workpiece spindle head 3. It is used to grip the workpiece, in this case the round rod 6. The chuck 4 is embodied such that the round rod 6 can be moved through the chuck and securely clamped in the desired axial positions by means of the clamping jaws 5 (FIG. 2). Positioned opposite the workpiece spindle head 3 on the grinding table 2 is a tailstock 7 that receives a sleeve 8 that can travel in the axial direction. The arrow 9 indicates the sleeve movement. The exterior end of the sleeve 8 that faces the workpiece spindle head 3 is embodied as a hollow center punch 10 and receives the end of the round rod that is ground to an end-face taper.

Two steadies are labeled 11 and 12 and they can be positioned for providing additional support at the end region of the round rod 6. The arrows 13 and 14 in FIG. 2 indicate the direction of movement of the steadies 11 and 12.

The round rod 6, the workpiece spindle head 3, the chuck 4, the sleeve 8, and the tailstock 7 form a common center axis 15 that can also be called a common functional axis.

Also in FIG. 1 there is a grinding spindle head 16 that carries a first grinding spindle 17 and a second grinding spindle 18. The first grinding spindle 17 is fitted with a first grinding wheel 20 and the second grinding spindle 18 is fitted with a second grinding wheel 21. The grinding spindle head 16 can be pivoted about a first pivot axis 19 that is oriented perpendicular to a plane in which lies the common axis 15 of the workpiece spindle head 3, round rod 6, and tailstock 7. As can be seen with nothing further from the illustration in accordance with FIG. 1, the first grinding wheel 20 or the second grinding wheel 21 can be selectively moved into the working position by pivoting the grinding spindle head 16 about the pivot axis 19. Moreover, the grinding spindle head 16 can also travel linearly in the direction of the X axis. The travel in the direction of the X axis is also CNC-controlled. The grinding spindles 17 and 18 contain integrated electromotors that drive the grinding wheels 20, 21 rotationally.

Further illustrated in FIG. 1 is a sensor 42 which is allocated to the chuck 4 of the workpiece spindle head 3. The sensor 42 checks the remaining length of the round rod 6 that is available for moving the round rod 6 through the chuck 4, at least during every chucking procedure. When a minimum remaining length of the round rod 6 is not met, the sensor 42 provides a signal and/or stops the circular grinding machine.

Figure 3:
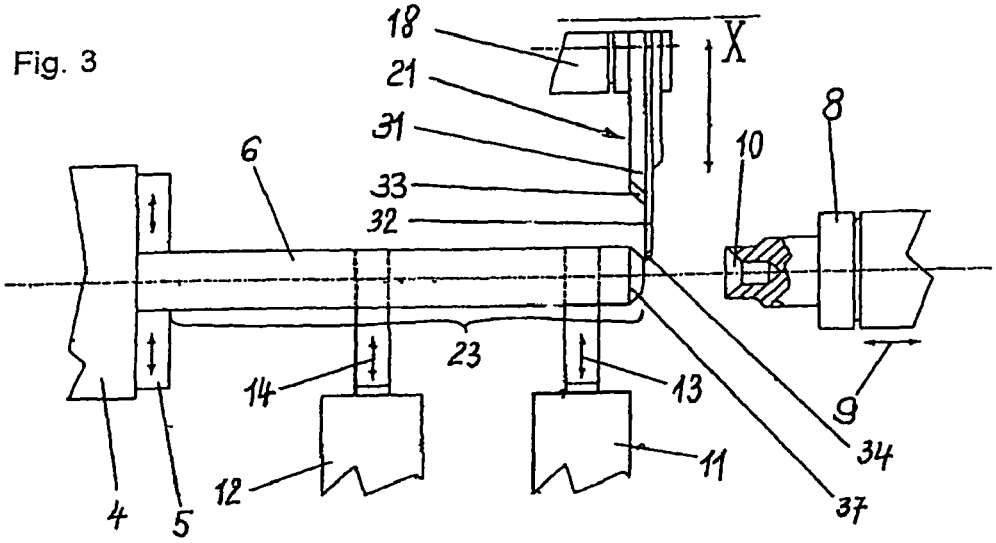
FIG. 3 is an illustration corresponding to FIG. 2 depicting the grinding of an end-face taper on the round rod.
Figure 4:
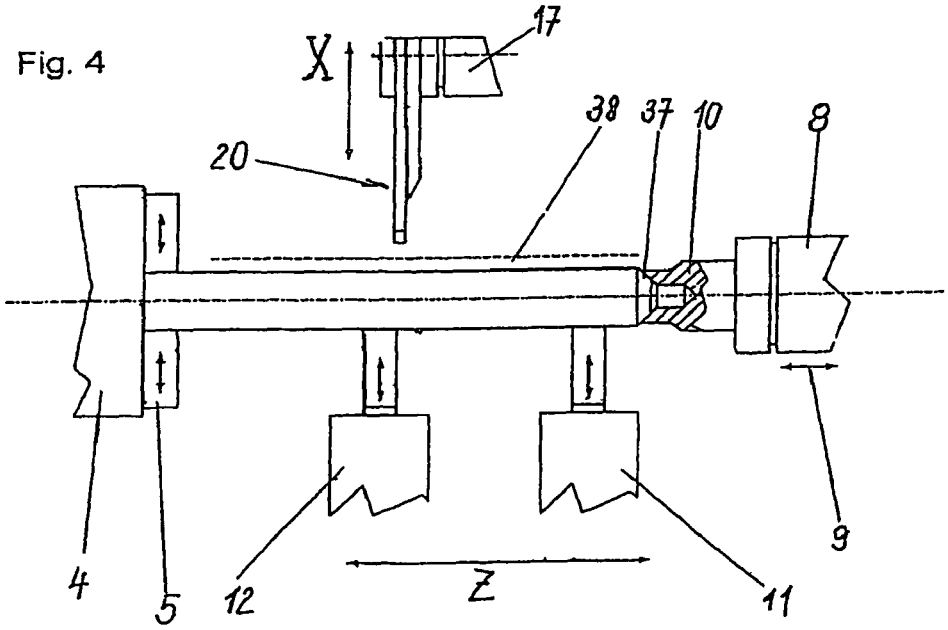
FIG. 4 illustrates all of the options for gripping the end region of the round rod that projects from the workpiece spindle head.

Additional details of the circular grinding machine illustrated in FIG. 1 are found in FIGS. 2 through 4.

Thus in FIG. 2 the clamping jaws 5 of the chuck 4 can be seen that clamp the round rod 6 for the grinding procedure. As stated, the round rod 6 can be moved through the chuck 4 and securely clamped in a selectable axial position. When this happens, an end region 23 of the round rod 6 projects out of the chuck 4 and the workpiece spindle head 3. The length of the end region 23 is approximately equal to the length of the hard metal tool to be produced plus a certain clamping and processing length (see FIG. 5).

Figure 5:
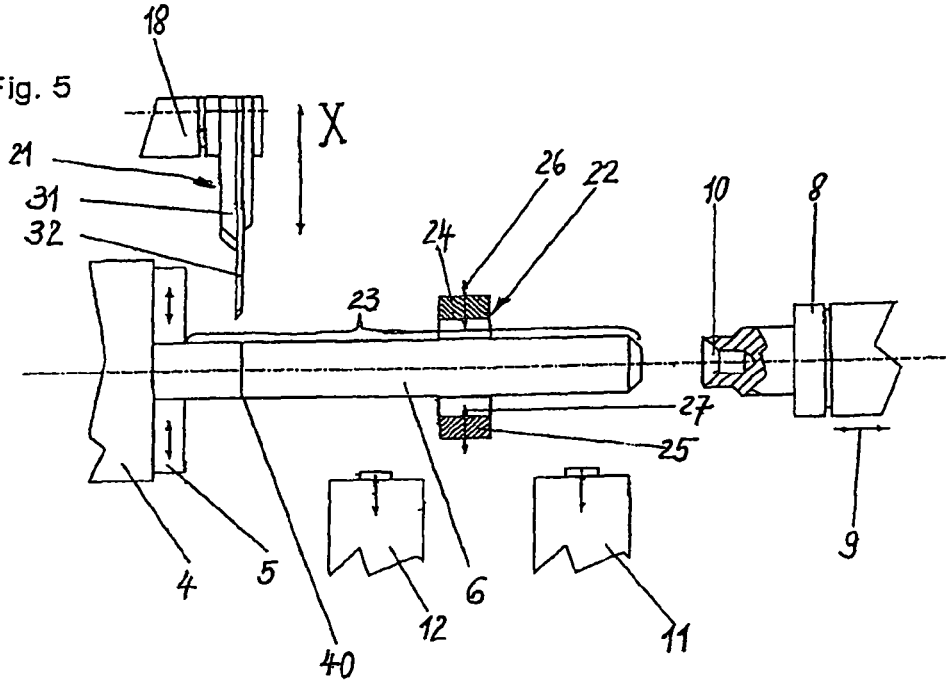
FIG. 5 in addition illustrates the gripping unit that is employed when separating the end region from the round rod.

FIG. 5 also schematically illustrates a gripping unit 22 whose clamping parts 24 and 25 can grip and hold the end region 23 of the round rod from the outside. The arrows 26, 27 indicate the movement of the clamping parts 24, 25.

FIG. 2 illustrates how the first grinding spindle 17 of the grinding spindle head 16 travels into the working position. The first grinding wheel 20 is illustrated enlarged. It has a base body 28 with a larger axial extension and a narrow region 29 projecting radially therefrom. The narrow region 29 carries the grinding coating 30 that has a cylindrical contour. The grinding wheel 20 is for instance embodied as a diamond grinding wheel with a grinding coating that is approx. 5 mm high.

In contrast, in FIG. 3 the second grinding spindle 18 with the second grinding wheel 21 is in the working position. The second grinding wheel 22 has a first individual wheel and a second individual wheel 32. The second grinding wheel can be embodied as a multiple grinding wheel. However, the two individual wheels 31 and 32 can also be called parts of a common grinding body with a single base body. The grinding coatings of the two individual wheels 31 and 32 are labeled 33 and 34. The two individual wheels 31 and 32 have a different axial thickness and are both fitted with conical grinding surfaces that have opposing inclines.

In accordance with the illustration in FIG. 5, as well, the second grinding spindle 18 with the second grinding wheel 21 is employed.

The other machine parts that are illustrated in FIGS. 2 through 5 have the previously mentioned reference numbers and are therefore not detailed individually.

The grinding procedure to be performed on the grinding machine in accordance with FIGS. 1 through 6 occurs in the following manner:

The starting material is the previously mentioned round rod 6 made of a sintered hard metal. Such a round rod, which can have for instance a length of 300 to 400 mm, is moved through the chuck 4 of the workpiece spindle head 3 until an end region 23 (FIG. 2) of the desired length projects from the chuck 4. In this position the clamping jaws 5 are moved against the round rod 6 so that the latter is securely clamped.

Then the first grinding spindle 17 of the grinding spindle head 16 is brought into the working position. Thus a first steady rest 35 is ground into the end region 23 of the round rod 6 by means of the first grinding wheel 20 that is located on the first grinding spindle 17 and that is rotatingly driven. Then the first steady 11 is moved in the direction of the arrow 13 against the first steady rest 35 so that the end region 23 is securely supported during further grinding procedures.

When necessary, a second steady rest 36 or additional steady rests can be ground into the end region 23 of the round rod 6. The second steady 12 is provided for this, for instance. During this, the steady rest 36, which is arranged closer to the chuck 4, is then ground first and then the steady rest 35 is ground.

In accordance with the illustration in accordance with FIG. 3, both steadies 11 and 12 are placed against the associated steady rests 35, 36. The end region 23 is thus securely supported. Now the second grinding spindle 18 with the second grinding wheel 21 is brought into the working position. Its first individual wheel 31 then grinds a first end-face taper 37 into the end face of the round rod 6, that is, its end region 23, that faces the tailstock 7. The first end-face taper 37 is dimensioned such that it fits into the hollow center punch 10 of the sleeve 8 that is displaceably arranged in the direction of the arrow 9 in the tailstock 7.

FIG. 4 illustrates the condition in which the free end of the end region 23 with the first end-face taper 37 is securely gripped in the hollow center punch 10. Located in the working position again is the first grinding spindle 17 of the grinding spindle head 16, which is again positioned in the direction of the X axis at the end region 23 CNC controlled. At the same time, the grinding table 2 travels CNC-controlled in the direction of the Z axis. In this manner nearly the entire length of the end region 23 is circular ground in the rough-grinding procedure by means of the first grinding wheel 20. This means that this length is ground in a single procedure of the grinding wheel 20 on the end region 23. However, it is also possible to use a wider grinding wheel and to perform the procedure in the pendulum grinding method. In this case, there are then a plurality of radial positioning movements, and the longitudinal movement must be repeated multiple times until grinding overmeasure 38 is carried off and the desired surface condition of the end region 23 has been attained.

FIG. 4 illustrates a condition in which the steadies 11 and 12 are also positioned against the end region 23 during this part of the procedure. However, this is by no means required. The use of the steadies 11 and 12 is primarily unavoidable when the first end-face taper 37 is being ground. In the following procedures, work can also be performed in that the steadies are then retracted.

The procedure of circular grinding illustrated in FIG. 4 is by no means limited solely to obtaining a continuously cylindrical contour of the desired surface quality. On the contrary, in this method step the entire circular-ground final contour of the resulting finished hard metal tool should be attained. That is, depending on the final contour of the tool, partial regions can already be ground out with cylindrical, tapered, or spherical contours in this stage of the method in which the end region 23 is still situated on the round rod. All contours that can be obtained by circular grinding are conceivable. This can also occur in that a set of grinding wheels with different are employed. This is not illustrated in FIG. 4, however.

Figure 7:
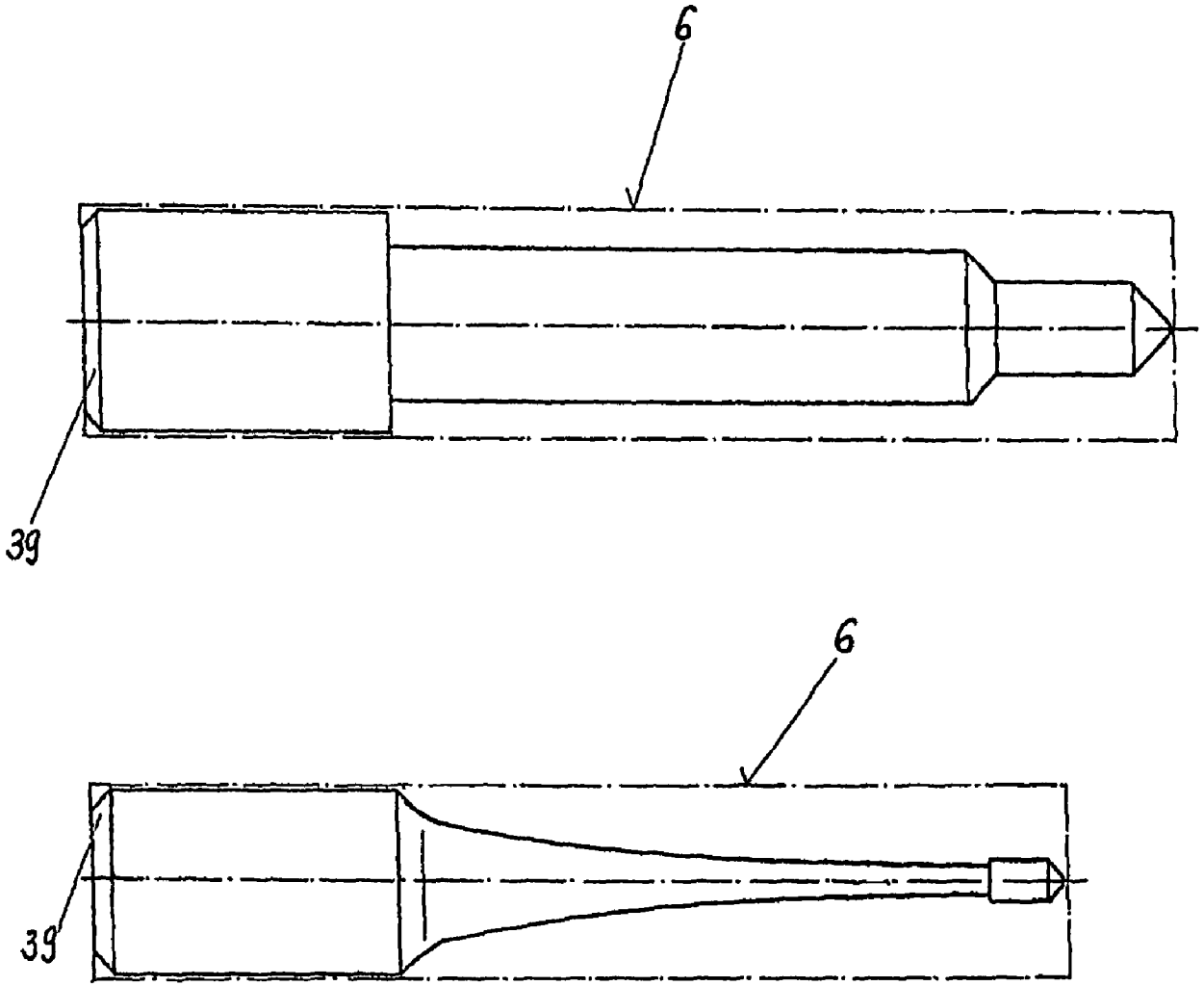
FIG. 7 illustrates two different hard metal tools in the condition of their circular-ground final contour.

FIG. 7 illustrates examples of such circular-ground final contours.

The end region 23 of the round rod 6 and thus the resulting hard metal tool are therefore thus finish ground. The term "finish grinding" here does not mean finish grinding in the sense of smoothing as opposed to roughing, but rather the most final stage that can be attained for the resulting tool by circular grinding. Then cutting, spiral cutting, and the like must be performed in separate methods. First, however, it is necessary to separate the thus finish-ground tool from the round rod 6.

Figure 5A:
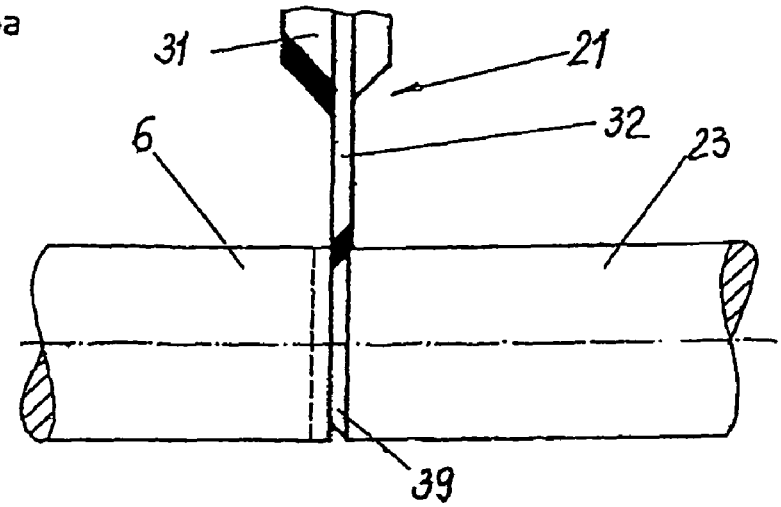
FIGS. 5*a*, 5*b*, and 5*c* illustrate the sequence of the separation procedure after circular grinding of the resulting tool.

The procedure is explained using FIGS. 5 and 5*a* through 5*c*. The final region 23 of the round rod 6 is first still clamped at both ends, as illustrated in FIG. 4. One or a plurality of steadies can be positioned at the end region 23; however, this is not required. Deviating from the illustration in accordance with FIG. 4, the second grinding spindle 18 is brought into the working position in that the grinding spindle head 16 is pivoted about the pivot axis 19. Now the second individual wheel 32 of the second grinding wheel 21, which is a multiple grinding wheel and which has a larger diameter than the first individual wheel 31, is employed. The rotating second individual wheel 32 is then positioned against the also rotating end region 23 of the round rod 6. This first positioning procedure is then interrupted as soon as the second individual wheel 32 has ground the second end-face taper 39 (FIG. 5*a*).

Figure 5B:
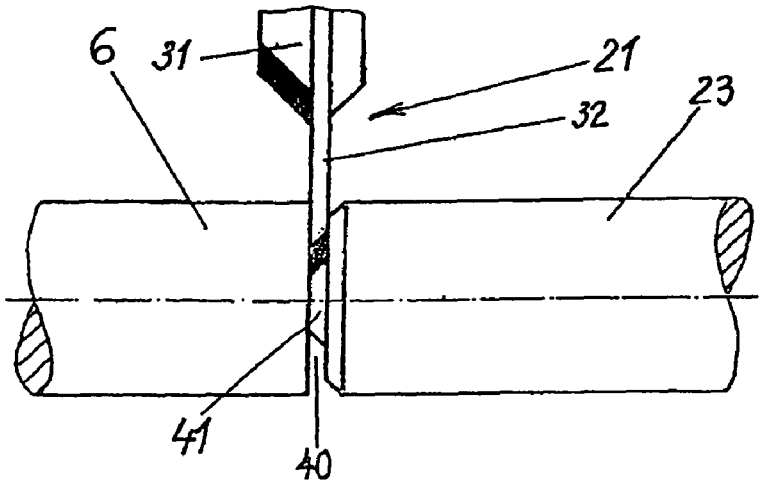

Then the second grinding wheel 21 is retracted from the end region 23 of the round rod 6. The round rod 6 and the second individual wheel 32 are mutually offset axially relative to one another. The offset is approximately the thickness of the second individual wheel 32. Then the individual wheel 32 is again positioned against the end region 23 of the round rod 6 and this time effects a separating cut 40. The procedure is continued until the connection between the remaining residual length of the round rod 6 and its end region 23 comprises only a narrow connecting band 41. Until this point the end region 23 of the round rod 6 was clamped at its two ends and driven to rotate (FIG. 5*b*).

Figure 5C:
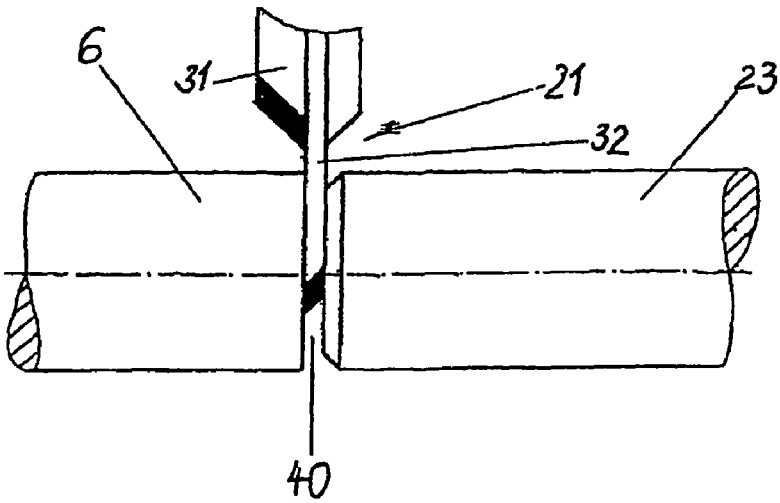

Then the rotational drive of the workpiece spindle head is stopped, and the tailstock 7 with the sleeve 8 is retracted from the clamping position. The end region 23 of the round rod 6 with the first end-face taper 37 is now free and is enclosed and securely held by the clamping parts 24, 25 of the gripping unit 22. Further positioning of the second individual wheel 32 then continues the separating process and the connecting band 41 is also ground off (FIG. 5*c*). The tool, which is finished in terms of circular grinding, is now separated from the remainder of the round rod 6 and thus finished. The resulting hard metal tool is held in the gripping unit 22 and is removed from the machine and deposited by the gripping unit (see FIG. 5).

Figure 6:
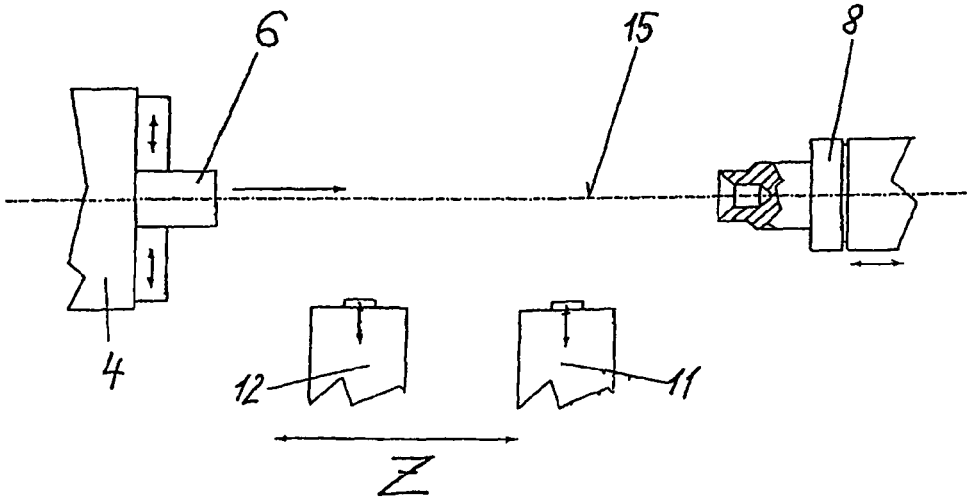
FIG. 6 schematically depicts the transition to circular grinding of the following end region on the round rod.

Then the round rod is again moved out of the chuck 4 a bit so that the next end region 23 can be processed (FIG. 6).

FIG. 7 illustrates two different hard metal tools in one stage as can be attained with the inventive method and the inventive circular grinding machine. The second end-face taper can be seen on the illustrated, thus finish-ground tools at their one end. The original cylindrical contour of the round rod 6 is illustrated with the dashed lines, so that it can be seen how the desired circular-ground final contour was obtained solely by circular grinding. The figure makes it possible to see clearly that graduated cylindrical, tapered, or spherical contours can be obtained with nothing further. The special aspect of this is comprised in that these numerous shapes were created, whereby at least at the one end a single clamping of the round rod forming the starting material was sufficient.

It should be remarked that the performance of the method is not limited to the measures depicted in FIGS. 1 through 5. It is even possible to make do with a single grinding wheel for all of the procedures when it is possible to position this grinding wheel in an inclined position against the round rod.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

What is claimed is:

1. A method for producing one more sintered hard metal tools on a circular grinding machine, said circular grinding machine including a workpiece spindle head and a tailstock, said method comprising the following steps:

providing a round rod formed of sintered hard metal, a length of said round rod being a multiple of a length of an individual tool;

positioning said round rod through said spindle head; and chucking said round rod in a chuck of said workpiece spindle head such that an outwardly projecting end region of said round rod outwardly projects from said workpiece spindle head and faces said tailstock;

executing processing including:

grinding a steady rest on said outwardly projecting end region of said round rod and placing a steady on said steady rest;

grinding a first end face taper on an end race of said outwardly projecting end region of said round rod;

fitting and clamping said first end face taper in a hollow center punch, said hollow center punch being located on a sleeve of said tailstock;

circular grinding said outwardly projecting end region of said round rod to a circular ground final contour over a length that defines the individual tool daring said round rod being chucked by said chucking;

gripping said outwardly projecting end region using a gripping unit after said circular grinding;

cutting off said individual tool from said round rod during said gripping;

removing said individual tool from the machine by operation of said gripping unit after said cuffing off;

releasing said chuck of said workpiece spindle head after said removing said individual tool; and moving said round rod in said workpiece spindle head toward said tailstock; and clamping said chuck such that a further outwardly projecting end region of said round rod is outwardly projecting from said workpiece spindle head and facing said tailstock and is processed according to said processing.

2. The method of claim 1, wherein during said circular grinding of said outwardly projecting end region of said round rod, said steady is retracted from said steady rest.

3. The method of claim 1, wherein two steady rests are ground axially spaced from one another on said outwardly projecting end region of said round rod.

4. The method of claim 1, further comprising rough grinding said round rod with a narrow grinding wheel or pendulum grinding said round rod with a wide grinding wheel.

5. The method of claim 1, further comprising:

monitoring a length of said round rod which is a length of a portion of the round rod disposed within said chuck; and signaling and/or stopping said circular grinding machine upon determining that said length of said round rod disposed within said chuck is less than a predetermined length.

6. A circular grinding machine for producing one or more tools which have a contour, said machine comprising:

a machine bed;

a grinding table movable on said machine bed;

a workpiece spindle head and a tailstock disposed on said grinding table;

a sintered hard metal round rod carried in said workpiece spindle head;

a chuck disposed on said workpiece spindle head, said workpiece spindle head being configured to have said sintered hard metal round rod, dimensioned as a multiple of a length of an individual tool, movable through said workpiece spindle head and axially positionable in said chuck;

a steady unit and a gripping unit both disposed between said workpiece spindle head and said tailstock;

an end region of said round rod being disposed outwardly from said chuck, and said tailstock having a hollow center punch and means for securing an end face taper at an end of said end region in said hollow center punch prior to grinding said contour, and said means for securing operating to secure the end face taper by movement of the tailstock in an axial direction of the hollow center punch to engage an interior wall of a hollow of the hollow center punch with the end face taper to apply pressure in an axial direction of the round rod to the end face taper such that centering radial forces are effected by virtue of a taper angle of the end face taper engaging the interior wall and the movement of the tailstock in the axial direction of the hollow center punch;

said gripping unit having means for gripping said round rod so that an individual tool formed on said round rod by said grinding machine is securely held during grinding of said individual tool; and a grinding spindle head unit comprising one or more grinding spindles, said grinding spindle head unit having means for engaging one or a plurality of different grinding wheels against said round rod so as to grind said end face taper and said contour, and said grinding spindle head unit having means for grinding off said individual tool in conjunction with said gripping unit holding said individual tool during said grinding off.

7. The circular grinding machine of claim 6, wherein:

said workpiece spindle head, said round rod, and said tailstock are disposed on a first common axis;

said grinding spindle head unit including two grinding spindles, said spindles being pivotable about a pivot axis, said pivot axis being oriented perpendicular to a predetermined plane; and said first common axis being disposed on said predetermined plane.

8. The circular grinding machine of claim 6, wherein said plurality of grinding wheels comprises differing diameters, widths, and/or exterior contours, and said plurality of grinding wheels being adjacently disposed on a common spinning axis.

9. The circular grinding machine of claim 8, wherein said individual grinding wheels are disposed in a common grinding body.

10. The circular grinding machine of claim 6 wherein said machine further comprises a CNC control.

11. The circular grinding machine of claim 6, further comprising a sensor allocated to said chuck, said sensor monitoring a length of a portion of said round rod remaining disposed within said chuck and yet to be extended from said workpiece spindle head towards said tailstock, and said machine signaling and/or stopping upon determining that said length of said round rod disposed within said chuck is less than a predetermined length.

12. The circular grinding machine of claim 6 wherein said steady unit includes means for engaging said round rod in conjunction with said grinding spindle head unit grinding said end face taper to support said round rod during grinding of said end face taper.

13. The circular grinding machine of claim 12 wherein said steady unit includes means for disengaging from said round rod in conjunction with said grinding spindle head unit completing said grinding of said end face taper and remaining disengaged from said round rod during said grinding spindle head unit grinding said contour.

14. A circular grinding machine for producing one or more tools which have a contour from a metal rod, said machine comprising:

a machine bed;

a grinding table movable on said machine bed;

a workpiece spindle head and a tailstock disposed on said grinding table;

a chuck disposed on said workpiece spindle head;

said workpiece spindle head being configured to have said metal rod movable through said workpiece spindle head and axially positionable in said chuck to expose an end region of said metal rod outwardly from said chuck wherein said metal rod is dimensioned as a multiple of a length of an individual tool to be produced;

a steady unit and a gripping unit both disposed between said workpiece spindle head and said tailstock;

said tailstock having a hollow center punch and means for securing an end face taper at an end of said end region in said hollow center punch prior to grinding said contour, and said means for securing operating to secure the end face taper by movement of the tailstock in an axial direction of the hollow center punch to engage an interior wall of a hollow of the hollow center punch with the end face taper to apply pressure in an axial direction of the round rod to the end face taper such that centering radial forces are effected by virtue of a taper angle of the end face taper engaging the interior wall and the movement of the tailstock in the axial direction of the hollow center punch;

said gripping unit being having means for gripping said metal rod so that an individual tool formed on said metal rod by said grinding machine is securely held during grinding off said individual tool; and a grinding spindle head unit comprising one or more grinding spindles, said grinding spindle head unit having means for engaging one or a plurality of different grinding wheels against said metal rod so as to grind said end face taper and said contour, and said grinding spindle head unit having means for grinding off said individual tool in conjunction with said gripping unit holding said individual tool during said grinding off.

15. The circular grinding machine of claim 14, wherein:

said workpiece spindle head, said metal rod, and said tailstock are disposed on a first common axis;

said grinding spindle head unit including two grinding spindles, said spindles being pivotable about a pivot axis, said pivot axis being oriented perpendicular to a predetermined plane; and said first common axis being disposed on said predetermined plane.

16. The circular grinding machine of claim 14, wherein said plurality of grinding wheels comprises differing diameters, widths, and/or exterior contours, and said plurality or grinding wheels being adjacently disposed on a common spinning axis.

17. The circular grinding machine of claim 16, wherein said individual grinding wheels are disposed in a common grinding body.

18. The circular grinding machine of claim 14 wherein said machine further comprises a CNC control.

19. The circular grinding machine of claim 14, further comprising a sensor allocated to said chuck, said sensor monitoring a length of a portion of said metal rod remaining disposed within said chuck and yet to be extended from said workpiece spindle head towards said tailstock, and said machine signaling and/or stopping upon determining that said length of said metal rod disposed within said chuck is less than a predetermined length.

20. The circular grinding machine of claim 14 wherein said steady unit includes means for engaging said metal rod in conjunction with said grinding spindle head unit grinding said end face taper to support said metal rod during grinding of said end face taper.

21. The circular grinding machine of claim 20 wherein said steady unit includes means for disengaging from said metal rod in conjunction with said grinding spindle head unit completing said grinding of said end face taper and remaining disengaged from said metal rod during said grinding spindle head unit grinding said contour.

* * * * *